United States Patent [19]

Chessin

[11] 4,206,019

[45] Jun. 3, 1980

[54] NOVEL LOW CONCENTRATION DECORATIVE CHROMIUM PLATING BATHS AND METHOD

[75] Inventor: Hyman Chessin, Brick Township, Ocean County, N.J.

[73] Assignee: M&T Chemicals Inc., Woodbridge, N.J.

[21] Appl. No.: 894,385

[22] Filed: Apr. 7, 1978

[51] Int. Cl.[2] ..... C25D 3/04

[52] U.S. Cl. ..... 204/51

[58] Field of Search ..... 204/51, 43 R

[56] References Cited

U.S. PATENT DOCUMENTS

| | | | |
|---|---|---|---|
| 3,074,859 | 1/1963 | Latawiec et al. | 204/43 R |
| 3,248,310 | 4/1966 | Schaer | 204/51 |
| 3,475,294 | 10/1969 | Seyb et al. | 204/51 |
| 3,505,183 | 4/1970 | Seyb et al. | 204/51 |
| 3,745,097 | 7/1973 | Chessin et al. | 204/51 |

*Primary Examiner*—G. L. Kaplan

*Attorney, Agent, or Firm*—Kenneth G. Wheeless; Robert Spector

[57] ABSTRACT

A bright decorative plating process for electroplating chromium on a basis metal, characterized by high coverage and throwing power, utilizes a chromic acid plating bath containing the anion of an organic carboxylic acid or a halogenated organic carboxylic acid. The baths are of unprecedentedly high $CrO_3$ to sulfate ratio, 600–3000:1. They may be of the self-regulating type. They contain a fluoride or complex fluoride as an auxiliary catalyst. The carboxylic acid anion may be added by introducing into the bath the acid itself, or a soluble salt of the acid, or the acid anhydride. The anions of the aliphatic dicarboxylic acids such as adipic acid and succinic acid anhydride are preferred. The concentration of the carboxylic acid anion is preferably from 0.5 to 32 grams per liter.

9 Claims, No Drawings

NOVEL LOW CONCENTRATION DECORATIVE CHROMIUM PLATING BATHS AND METHOD

This invention relates to a novel process and composition for electrodeposition of bright decorative chromium. More particularly, it relates to a chromium plating process characterized by highly dilute decorative chromium electroplating baths.

Low concentration chromium plating baths containing 20–150 g/l chromic acid produce excellent clear bright chromium deposits over a wide current density range and with little or no low-current-density filming when the conditions are:

| | |
|---|---|
| ($CrO_3$) | 20–150 g/l |
| ($CrO_3$)/($SO_4$=) | 600–3000 |
| ($CrO_3$)/($F^-$) | 20–1500 |
| ($CrO_3$)/(alkyl carboxylate) | 4–150 |
| ($CrO_3$)/(heavy metal impurities) | ≥20 |

Novelty was discovered in the fact that superior chromium deposits may be obtained by plating from a high ratio of chromic acid to sulfate, at ratios greater than 600:1, when the proper balance of the other constituents is maintained.

The alkyl carboxylate may be a mono or a poly carboxylate and it may also be a stable substituted carboxylate. For example, halogen-substituted carboxylates are stable as are carboxylates with sulfonic or sulfate groups thereon. Hydroxy-substituted carboxylates, such as tartaric acid, are not stable and will oxidize in solution especially when electrolysis is applied.

Fluoride ($F^-$) is a general term to include fluoride, $F^-$, and complex fluorides; e.g. $BF_4^-$, $ZrF_6$=, $TiF_6$=, $SiF_6$=, $AlF_6$=.

This invention lies in the discovery that there is a new and totally unexpected region of operation in chromium plating from dilute chromic acid—containing plating baths which yields superior chromium deposits over a wide plating range.

It is an object of this invention to provide a process for electrodepositing bright decorative chromium plate, characterized by its high coverage of low current density areas. Other objects will be apparent to those skilled-in-the-art on inspection of the following description.

In accordance with certain of its aspects, the process of this invention, characterized by high coverage and by high throwing power, for electrodepositing a bright decorative chromium plate onto a basis metal may comprise maintaining an aqueous hexavalent chromium plating bath containing chromic acid and sulfate in ratio of 600–3000:1, at least about 0.1 g/l of fluoride, and at least about 0.5 gram per liter of an anion of an organic carboxylic acid or a halogenated organic carboxylic acid; and electrodepositing a chromium plate from said bath onto said basis metal as cathode in said bath.

The chromium plating bath which may be employed in practice of this invention is an aqueous solution containing 20–150 g/l of chromic acid $CrO_3$ and 0.01 g/l–0.25 g/l, say 0.12 g/l of sulfate ion $SO_4$=, typically added as sodium sulfate and 0.5 g/l–2 g/l of fluoride ion, $F^-$ typically added as sodium bifluoride. In practice of this invention, the ratio of $CrO_3$:$SO_4$= is maintained at 600–3000:1.

It is a particular feature of this invention that the novel results may be attained (a) in a standard, non-self regulating bath as described supra or (b) in a self-regulating bath. Another typical mixed catalyst bath which may be employed may contain 20–150 g/l of chromic acid $CrO_3$ and 0.01–0.25 g/l, say 0.06 g/l of sulfate $SO_4$= ion; and 0.1–2.0 g/l, say 0.6 g/l of silicofluoride $SiF_6$= ion. It will be noted that the ratio as the term is used in this application refers to the ratio $CrO_3/SO_4$= wherein each of the quantities is expressed in grams.

This invention may also be used in a self-regulating bath, e.g. of the sulfate type, which may contain 20–150 g/l of chromic acid; and 0.001 to 0.25 g/l or more of strontium sulfate; plus optionally an additional strontium compound source of excess strontium ion, such as strontium hydroxide, strontium chromate, etc. in amounts to provide 0–20 g/l strontium ion $Sr++$. The ratio $CrO_3$ to $SO_4$= is maintained at 600–3000:1.

Similarly the fluoride or complex fluoride ion may be self-regulated by use of appropriate compounds of limited solubility. For example, the potassium ion may be used to regulate the concentration of the silicofluoride ion; the calcium or cerium ions may be used to regulate the concentration of the fluoride ion.

The organic carboxylic acids or halogenated organic carboxylic acids which may be added, either as such or e.g. as their anhydrides or salts (typically the sodium salt), to chromium plating baths in practice of this invention may typically include:

a. aliphatic monocarboxylic acids,
b. halogenated aliphatic monocarboxylic acids,
c. aliphatic polycarboxylic acids,
d. halogenated aliphatic polycarboxylic acids,
e. aromatic monocarboxylic acids,
f. halogenated aromatic polycarboxylic acids,
g. polyhalogenated aromatic monocarboxylic acids, and
h. polyhalogenated aromatic polycarboxylic acids.

Typical illustrative monohalogenated aliphatic monocarboxylic acids which may be employed may include:

chloracetic acid
2-chloropropionic acid
3-bromopropionic acid
3-iodopropionic acid
2-chlorobutanoic acid
chloropivalic acid (monochlorinated tertiary pentanoic acid)
2-chloropentanoic acid Typical illustrative polyhalogenated aliphatic monocarboxylic acids which may be employed may include:

di or tri chloracetic acid
2,2-dichloropropionic acid
2,2,3-trichloropriopionic acid
pentafluoropropionic acid Typical illustrative monohalogenated aliphatic dicarboxylic acids which may be employed may include:

chloromalonic acid
2-chlorosuccinic acid
2-bromosuccinic acid
2-chloroadipic acid Typical illustrative polyhalogenated aliphatic dicarboxylic acids which may be employed may include:

2,2-dichlorosuccinic acid
2,2-dichloroadipic acid
tetrachlorosuccinic acid
2,3-dibromosuccinic acid
3,3-diiodosuccinic acid 3,4-dichloroadipic acid Typical illustrative monohalogenated aromatic monocarboxylic acids which may be employed may include:

3-chloro-4-sulfobenzoic acid 3-bromo-4-sulfobenzoic acid

Typical illustrative monohalogenated aromatic dicarboxylic acids which may be employed may include:

4-chlorophthalic acid 2-bromoterephthalic acid

Typical illustrative polyhalogenated aromatic monocarboxylic acids which may be employed may include:

3,5-dichloro-4-sulfobenzoic acid 3,6-dibromo-4-sulfobenzoic acid

Typical illustrative polyhalogenated aromatic dicarboxylic acids which may be employed may include:

3,4-dichlorophthalic acid 3,4-dibromophthalic acid 4,5-dichlorophthalic acid

Other acids falling within the scope of this invention will be apparent to those skilled-in-the-art.

The preferred acids include aliphatic dicarboxylic acids and most preferably a halosuccinic acid such as 2-chlorosuccinic acid or 2,2-dichlorosuccinic acid or 2,3-dibromosuccinic acid or a haloadipic acid such as 3,4-dichloroadipic acid.

In practice of this invention, the carboxylic acid is added to the electroplating bath in amounts from 0.5 up to 32 g/l, and preferably from 2 to 25 g/l. The acids employed will preferably be those having a solubility in the plating bath within these ranges. Solubilizing substituents such as sulfo groups may be included in the carboxylic acid in order to increase solubility in the plating bath.

A typical composition which may be premixed, and added to a water solution in which the concentration of $SO_4^=$ ion and components including, e.g., $SiF_6^=$, may be adjusted separately, may include the compositions indicated in Table I and II below (here as elsewhere, unless otherwise indicated, all parts are parts by weight). It will be apparent that these compositions, like other chromic acid-containing compositions, should preferably be formed, maintained, and stored in a manner to minimize contact with extraneous organic compositions and materials; and preferably they will be formed, stored, and maintained at temperature below 80° C. It will also be apparent that in compositions hereinafter designated as containing "halo-organic acid", halo-organic acid containing at least two carbon atoms is intended and equivalent amounts of anhydride, salt, etc. may be employed, thus yielding appropriate amounts of the desired ion. All amounts are in grams per liter.

TABLE I

| Component | Max | Min | Preferred A | Preferred B |
|---|---|---|---|---|
| $CrO_3$ | 150 | 20 | 120 | 80 |
| organic acid | 32 | 0.5 | 8 | 5 |

A preferred composition may include:

TABLE II

| Component | Max | Min | Preferred A | Preferred B |
|---|---|---|---|---|
| $CrO_3$ | 150 | 20 | 120 | 80 |
| succinic acid anhydride | 32 | 1.5 | 8 | 5 |

The organic acid may be added as such, as the anhydride, or as the salt, typically as the sodium salt. In the preferred embodiment, the additive may be admixed with the other ingredients to be used to make up the bath.

TABLE III

| Component | Max | Min | Preferred A | Preferred B |
|---|---|---|---|---|
| $CrO_3$ | 150 | 20 | 120 | 80 |
| $SO_4^=$* | 0.25 | 0.01 | 0.12 | 0.08 |
| $F^-$ | 2 | 0.1 | 0.8 | 0.4 |
| organic acid | 32 | 0.5 | 8 | 5 |

*typically supplied as, e.g., sodium sulfate

A specific self-regulating composition may include:

TABLE IV

| Component | Max | Min | Preferred |
|---|---|---|---|
| $CrO_3$ | 150 | 20 | 120 |
| $SrSO_4$ | | 0.1 | 1 |
| $SrCrO_4$ | 20 | 0 | 10 |
| 2,2-dichloro-succinic acid | 32 | 0.5 | 8 |
| $CaF_2$ | | 0.2 | 1 |
| $CaCO_3$ | 10 | 0 | 2 |

A typical mixed catalyst composition may include:

TABLE V

| Component | Max | Min | Preferred A | Preferred B |
|---|---|---|---|---|
| $CrO_3$ | 150 | 20 | 120 | 80 |
| $SO_4^=$* | .25 | 0.01 | .13 | .05 |
| $SiF_6^=$** | 2.0 | 0.1 | 0.7 | 0.5 |
| organic acid | 32 | .5 | 8 | 5 |

*typically added as sodium sulfate

**typically added as sodium silicofluoride.

A preferred mixed catalyst composition may include:

TABLE VI

| Compomnent | Max | Min | Preferred A | Preferred B |
|---|---|---|---|---|
| $CrO_3$ | 150 | 20 | 120 | 80 |
| sodium sulfate | 0.40 | 0.02 | 0.18 | 0.12 |
| sodium silico-fluoride | 2.6 | 0.03 | 0.9 | 0.6 |
| 2,2'-dichloro-succinic acid | 32 | 0.5 | 8 | 5 |

A typical self-regulating composition having both sulfate and silicofluoride may include:

TABLE VII

| Component | Max | Min | Preferred A | Preferred B |
|---|---|---|---|---|
| $CrO_3$ | 150 | 20 | 120 | 120 |
| $SO_4^=$ | .20 | 0.005 | .05 | .13 |
| $SiF_6^=$ | 2.0 | 0.05 | 0.5 | 0.7 |
| $Sr^{++}$ | 10 | 0.004 | 4 | 2 |
| $K^+$ | 10 | 0.08 | 6 | 4 |
| halo-organic acid | 25 | 1.8 | 7 | 10 |

A preferred self-regulating composition may include:

TABLE VIII

| Component | Max | Min | Preferred |
|---|---|---|---|
| $CrO_3$ | 150 | 20 | 120 |
| $SrSO_4$ | 2 | 0.5 | 0.5 |
| $K_2SiF_6$ | 4 | 0.5 | 1.0 |
| $SrCrO_4$ | 20 | 0 | 5.0 |
| $K_2Cr_2O_7$ | 20 | 0 | 2.0 |
| succinic acid anhydride | 32 | 0.5 | 10 |

TABLE IX

| Component | Max | Min | Preferred |
|---|---|---|---|
| chromic acid | 150 | 20 | 120 |
| sulfate | 0.25 or | 0.01 | 0.2 |
| cerium fluoride | 4 more | 0.2 | 2.0 |
| adipic acid | 32 | 0.5 | 8 |

The baths useful in practice of this invention may be formed by dissolving the above compositions in aqueous medium to form baths containing 20–150 g/l of $CrO_3$ and corresponding quantities of the other components.

It is found that particularly outstanding results, in terms of handleability, packaging, ease of manufacture, as well as maximum coverage and brilliance of chromium deposit accompanied by a minimum of lead anode corrosion may be obtained when in the compositions of Tables I, III, V, and VII, the organic carboxylic acid or halo-organic acid is an aliphatic dicarboxylic acid; and such compositions are most highly preferred, because of their peculiarly unexpected superiority.

The baths of this invention which may be employed to readily and conveniently electrodeposit chromium plate, are characterized by high coverage and by high throwing power. These baths may be used to deposit chromium onto any basis metal. It is a particular feature of this invention that outstanding results may be obtained when the basis metal is a metal having an atomic number of 24–30. Typical of such basis metals are chromium, manganese, iron, cobalt, nickel, copper, and zinc. Mixture or alloys of these metals may be plated—typically brass, stainless steel, etc. The preferred basis metal may be nickel, or nickel-iron alloys, and preferably active nickel.

The preferred active nickel basis metal may be attained by electrodeposition of nickel onto a suitable substrate metal (such as iron).

Active nickel may be nickel which is highly receptive to the deposition thereon of a bright clear decorative plate and which has a surface which may be free of nickel compounds such as oxide. Typically nickel may be active when freshly plated onto a cathode. If not already active, the nickel may be rendered active by cathodic or other reducing treatment prior to the deposition of chromium plate thereon. Preferably this may be effected by maintaining the nickel as cathode in an aqueous electrolyte solution, preferably containing an acid. The preferred acids for use in either electrolytic or non-electrolytic techniques may include acids such as the common mineral acids, e.g. hydrochloric acid or sulfuric acid, etc. When the aqueous electrolyte solution is other than acid, it may preferably be followed by an acid dip.

It has been found when the high ratio baths of this invention are used to plate chromium onto bright nickel basis metal that it is advantageous to activate the bright nickel by applying to the cathode to be plated in the bath, a low voltage applied thereto at a time less than about five seconds after immersion and preferably to apply the voltage prior to immersion of the cathode. The low voltage may be sufficient to produce a cathode current density up to about 0.25–0.5 times the plating current density. Then the current density may be raised to its full operating value. This technique makes a bright nickel surface more receptive to the deposit of bright chromium from the baths of this invention.

The bath may be preferably at temperature of 30°–60° C., say 35°–50° C. A preferred cathode current density may be 0.3–40 amperes per square decimeter (asd) most preferably 0.5–20 asd. Plating may be carried out with air or mechanical agitation for any time to obtain a desired thickness, but for decorative plate it is usually ½–10 minutes; and typically one—three minutes may suffice.

During plating in accordance with the process of this invention, there is unexpectedly and surprisingly no appreciable loss of the organic carboxylic acid or halo-organic acid by decomposition over extended periods of time. For example, in tests, 2,2-dichlorosuccinic acid was found still to function satisfactorily after plating had been carried out for 110 ampere hours per liter and even longer.

At the conclusion of the plating time, the cathode will be found to be covered to a remarkable degree with clear, bright, decorative chromium plate. It is a particular feature of this invention that the plate is unexpectedly characterized by its high coverage without the need for conforming anodes. For example, articles containing deep recesses such as zinc based die cast automotive dashboard trim may be plated by the process of this invention (with no conforming anode) to unexpectedly yield a bright, uniform plate on both high and low current density areas. This has not heretofore been possible from such dilute baths.

The plate produced by the novel process of this invention may be found to be highly satisfactory with respect to its unusually bright, decorative appearance and its resistance to corrosion.

In the following series of illustrative examples, testing and the criteria for the deposits were established in a 534-ml Hull Cell containing 500 ml of solution. A brass Hull Cell panel, 100 mm wide, was first plated with bright nickel, activated, rinsed and inserted in the test solution at the proper end. The solution was maintained at a temperature of 42.8°–43.9° C. and 5 amperes were passed through the test solution for three minutes, rinsed, dried and examined. Notations were made as to the distance in mm from the HCD end of each effect. Coverage is defined as this distance for the extent of chromium metal.

Other temperatures of operation are also suitable so long as the proper adjustment in applied current is made. That is, higher temperatures of operation require higher currents to produce chromium deposits in the bright range and lower temperatures must utilize lesser currents.

Optimum compositions, too, may be adjusted for changes in plating temperature; e.g., the lower ratios may be more desirable at the elevated temperatures.

In the following series of illustrative examples the stock bath and the plating conditions were the same as in the previous examples, except that electrodeposition was conducted at 43° C.

In the following tests the superior deposits obtained in this new region consist of typically bright chromium metal deposited from zero (0) mm (i.e., the HCD edge of the test panel) to at least 78 mm and this with only barely perceptible hazes or films on the deposit or even in the region beyond where the deposit ends (e.g., 78–100 mm).

The combination containing only sulfate and fluoride (i.e., without the carboxylate) is inadequate to produce the desired results. This is borne out by several experimental sequences described below as examples 1–4. In all cases the concentration of chromic acid was 120 g/l.

| Example | $(SO_4^{=})$ g/l | $(CrO_3)/(SO_4^{=})$ | $(F^-)$ g/l | $(CrO_3)/(F^-)$ | Coverage mm | Remarks |
|---|---|---|---|---|---|---|
| 1a | 0.1 | 1200 | 0.2 | 600 | — | Passive |
| b | " | " | 0.4 | 300 | 82 | Passive streaks |
| c | " | " | 0.6 | 200 | 76 | Streaky gray plate |
| d | " | " | 0.8 | 150 | 67 | Streaky gray plate |
| 2a | 0.2 | 600 | 0.2 | 600 | 81 | Cr nice but LCD film |
| b | " | " | 0.4 | 300 | 79 | HCD slightly milky |
| c | " | " | 0.6 | 200 | 75 | Milkier |
| 3a | 0.3 | 400 | 0 | — | — | Iridescent bands |
| b | " | " | 0.1 | 1200 | — | Iridescent bands |
| c | " | " | 0.2 | 600 | 81 | Cr plate but LCD film |
| d | " | " | 0.4 | 300 | 84 | Cr plate but LCD film |
| e | " | " | 0.6 | 200 | 74 | Least film |
| 4a | 0.5 | 240 | 0 | — | — | Bronze passivity |
| b | " | " | 0.1 | 1200 | 82 | Heavy film |
| c | " | " | 0.2 | 600 | 77 | Heavy film |
| d | " | " | 0.3 | 400 | 68 | Plate OK but low coverage |
| e | " | " | 0.4 | 300 | 63 | Plate OK but low coverage |

Without the carboxylate the deposits were not commercially acceptable because they went from a passive to a filmed state without a commercial deposit in the sequence.

The effect of adding increasing amounts of a carboxylate, acetic acid in this case, is illustrated in example 5. In each experiment the chromic acid concentration was 120 g/l, the sulfate concentration was 0.2 g/l so that $(CrO_3)/(SO_4^{=})=600$ and the fluoride ion concentration was 0.5 g/l so that $(CrO_3)/(F^-)=240$.

| Example | (HOAc) Ml/l | $(CrO_3)/(HOAc)$ | Coverage mm | Remarks |
|---|---|---|---|---|
| 5a | 0 | — | 79 | Milky blue in HCD region |
| b | 0.2 | 600 | 79 | Blue deposit |
| c | 0.4 | 300 | 79 | Blue deposit |
| d | 0.8 | 150 | 82 | Deposit less blue |
| e | 1.6 | 75 | 78 | Deposit acceptable |
| f | 3.2 | 37.5 | 80 | Deposit very nice |
| g | 6.4 | 18.7 | 83 | Deposit very nice |
| h | 12.8 | 9.4 | 80 | HCD edge has approx. 1 mm haze. |

Two points are brought out in example 6, that a complex fluoride may be used instead of the simple fluoride ion and that increasing amounts of sulfate lead to increasing amounts of LCD film band, dubbed sulfate film band. $(CrO_3)=120$ g/l (succinic anhydride)=6.0 $(ZrF_6^{=})=1.0$

| Example | $(SO_4^{=})$ g/l | $(CrO_3)/(SO_4^{=})$ | Coverage mm | Remarks |
|---|---|---|---|---|
| 6a | 0.12 | 1000 | 81 | Passive spots. |
| b | 0.15 | 800 | 81 | Beautiful deposit. |
| c | 0.20 | 600 | 80 | Beautiful deposit. |
| d | 0.25 | 480 | 79 | Beautiful deposit. NOTE! |
| e | 0.30 | 400 | 79 | Start of LCD film band. |
| f | 0.40 | 300 | 80 | More LCD film band. |
| g | 0.55 | 218 | 74 | More LCD film band. |
| h | 0.70 | 171 | 65 | More LCD film band |

Example 7 shows the use of another complex fluoride.

| | | | |
|---|---|---|---|
| $(CrO_3)$ | 120 g/l | | |
| (succinic anhydride) | 6 | Ratio 20 | |
| $(SO_4=)$ | 0.15 | 800 | |

| Example | $(BF_4^-)$ g/l | $(CrO_3)/(BF_4^-)$ | Coverage mm | Remarks |
|---|---|---|---|---|
| 7a | 0.2 | 600 | — | Passive. |
| b | 0.3 | 400 | 81 | Good deposit. |
| c | 0.6 | 200 | 81 | Good deposit. |
| d | 0.8 | 150 | 80 | Slight overall haze. |
| e | 1.0 | 120 | 77 | Hazy, not acceptable. |

The following examples illustrate the usefulness with other carboxylates. In each case the following were maintained constant:

| | |
|---|---|
| $(CrO_3)$ | 120 g/l |
| $(SO_4 =)$ | 0.1 g/l |
| $(F^-)$ | 0.5 g/l |

| Example | Carboxylate | Conc. g/l | Ratio | Cvg. mm | Remarks |
|---|---|---|---|---|---|
| 8 | monochloroacetic acid | 4.7 | 25.5 | 81 | Beautiful deposits. |
| 9a | α,α'dichloro succinic acid | 6 | 20 | 82 | Beautiful deposits. |
| b | α,α'dichloro succinic acid | 8 | 15 | 81 | Beautiful deposits. |
| c | α,α'dichloro succinic acid | 12 | 10 | 79 | Beautiful deposits. |
| 10 | 3-bromopropionic acid | 10 | 12 | 81 | Slight haze but deposit acceptable. |
| 11 | adipic acid | 6 | 20 | 81 | Acceptable deposit. |
| 12 | tartaric acid | 5 | 24 | 73 | Deposit unacceptable. Evidence of high $Cr^{+3}$ in bath. |

The usefulness with even more dilute baths is illustrated in examples 13 and 14 which produced acceptable deposits.

| Example | ($CrO_3$) g/l | (Succinic-anhydride) g/l | ($CrO_3$)/(SA) | ($SO_4^=$) g/l | ($CrO_3$)/($SO_4^=$) | ($F^-$) g/l | ($CrO_3$)/($F^-$) | Coverages mm |
|---|---|---|---|---|---|---|---|---|
| 13 | 60 | 6.5 | 9.2 | 0.064 | 937 | 0.6 | 100 | 80 |
| 14 | 40 | 3.0 | 13.3 | 0.02 | 2000 | 0.4 | 100 | 85 |

EXAMPLE 15

The above results are in contrast with the test deposit produced by the "optimum" baths of Konishi.*

| | | |
|---|---|---|
| $CrO_3$ | 50 g/l | |
| $H_2SO_4$ | 0.5 g/l | Coverage 84 mm |
| $Na_2SiF_6$ | 0.5 g/l | |

In spite of the 30 second immersion after plating to remove films (as specified by Konishi) the test panel showed general blue films starting at about 25 mm and getting heavier at the lower current densities. In addition there was a heavy sulfate film band extending from 75–82 mm. The panel indicated that the deposit was not of commercially acceptable quality.

*Konishi, S. & Tadagoshi, M., "Metal Finishing" 71 (11) 49–52 (Nov., 1973)

EXAMPLE 16

This example illustrates the variability which may be obtained with the sulfate anion when the fluoride and the carboxylate are maintained constant. Constant:

| | | | |
|---|---|---|---|
| $CrO_3$ | 120 g/l | Ratio | |
| HOAc | 4 ml/l | 30 | |
| $F^-$ | 0.5 g/l | 240 | |
| | ($SO_4^=$) g/l | Ratio | Cvg. mm | Remarks |
| a | 0.05 | 2400 | 85 | Excellent deposit. |
| b | 0.10 | 1200 | 84 | Excellent deposit. |
| c | 0.15 | 800 | 80 | Excellent deposit. |

EXAMPLE 17 a. An example which illustrates the deleterious effect of heavy metal impurities: To a bath containing chromic acid 120, succinic anhydride 6, sulfate 0.12 and fluoride 0.5 g/l was added a mixture of ferrous oxalate and oxalic acid which produced ferric ion and chromic ion in equal amounts upon oxidation of the ferrous ion and the oxalate ion. Up to a total of 2 g/l each of $Fe^{+3}$ and $Cr^{+3}$ the deposits produced under standard test conditions were acceptable. Beyond this value, e.g., at 3 g/l each, the LCD filming became heavy enough to be objectionable.

b. Under the same circumstance—but without iron, chromic ion up to 4 g/l caused a little loss in coverage but at 6 g/l the loss was more substantial and an objectionable film band appeared.

c. Copper as cupric ion caused no deterioration at 4 g/l but at 6–8 g/l started to produce significant hazes which were not desirable.

Although this invention has been illustrated by reference to specific examples, numerous changes and modifications thereof which clearly fall within the scope of the invention will be apparent to those skilled-in-the-art.

What is claimed is:

1. The process characterized by high coverage and by high throwing power for electrodepositing a bright decorative chromium plate onto a basis metal which comprises maintaining an aqueous chromium plating bath containing 20–150 g/l chromic acid and 0.001–0.25 g/l sulfate ion, and a ratio of chromic acid to sulfate of 600–3000:1, and from 0.5 to 32 g/l of an anion of at least one organic carboxylic acid, and 0.05–2 g/l fluoride or complex fluoride ion, and electro-depositing a bright decorative chromium plate from said bath onto said basis metal as cathode in said bath.

2. The process for electrodepositing a bright decorative chromium plate onto a basis metal as claimed in claim 1 wherein said organic carboxylic acid is an aliphatic dicarboxylic acid.

3. The process for electrodepositing a bright decorative chromium plate onto a basis metal as claimed in claim 1 wherein said organic carboxylic acid is present in amount of 0.5 to 32 g/l.

4. The process characterized by high coverage and by high throwing power for electrodepositing a bright decorative chromium plate into a basis metal which comprises maintaining an aqueous mixed-catalyst chromium plating bath containing 20–150 g/l of chromic acid, 0.001–0.25 g/l of sulfate ion and 0.05–2.0 of silicofluoride ion, the ratio of chromic acid to sulfate ion being 600–3000:1, and 0.5 to 32 g/l of an anion of at least one organic carboxylic acid, and electrodepositing a bright decorative chromium plate from said bath onto said basis metal as cathode in said bath.

5. The process for electrodepositing a bright decorative chromium plate onto a basis metal as claimed in claim 4 wherein said organic carboxylic acid is a halogenated organic dicarboxylic acid.

6. The process characterized by high coverage and by high throwing power for electrodepositing a bright decorative chromium plate onto a basis metal which comprises maintaining an aqueous self-regulating chromium plating bath containing 20–150 g/l of chromic acid, at least 0.1 g/l of strontium sulfate and excess strontium ion, the ratio of chromic acid to sulfate of 600–3000:1 and 0.5–32 g/l of an anion of at least one organic carboxylic acid; and electrodepositing a bright decorative chromium plate from said bath onto said basis metal as cathode in said bath.

7. The process for electrodepositing a bright decorative chromium plate onto a basis metal as claimed in claim 6, wherein said organic carboxylic acid is a halogenated aliphatic dicarboxylic acid.

8. A chromium plating solution for the electrodeposition of bright chromium plate onto a basis metal which comprises an aqueous solution of 20–150 g/l of chromic acid 0.01–0.25 g/l of sulfate ion and 0.1–2 g/l of silicofluoride ion, the ratio of chromic acid to sulfate being 600–3000:1, and 0.5–32 g/l of at least one organic carboxylic acid.

9. A chromium plating solution for the electrodeposition of bright chromium plate onto a basis metal as claimed in claim 8 wherein at least one organic carboxylic acid is a halogenated aliphatic dicarboxylic acid.

* * * * *